US007250913B2

(12) United States Patent
Chang et al.

(10) Patent No.: US 7,250,913 B2
(45) Date of Patent: Jul. 31, 2007

(54) ANTENNA ASSEMBLY AND METHOD FOR FABRICATING THE SAME

(75) Inventors: Chih-Min Chang, Taipei (TW); Tzang-Chih Chiou, Taipei Hsien (TW)

(73) Assignee: BENQ Corporation, Taoyuan (TW)

( * ) Notice: Subject to any disclaimer, the term of this patent is extended or adjusted under 35 U.S.C. 154(b) by 72 days.

(21) Appl. No.: 11/311,676

(22) Filed: Dec. 19, 2005

(65) Prior Publication Data

US 2006/0132367 A1 Jun. 22, 2006

(30) Foreign Application Priority Data

Dec. 20, 2004 (TW) ..... 93139644 A

(51) Int. Cl.
*H01Q 1/24* (2006.01)

(52) U.S. Cl. ..... 343/702; 343/700 MS; 343/846

(58) Field of Classification Search ..... 343/700 MS, 343/702, 767, 829, 846
See application file for complete search history.

(56) References Cited

U.S. PATENT DOCUMENTS

| | | | | |
|---|---|---|---|---|
| 4,130,822 | A * | 12/1978 | Conroy | 343/700 MS |
| 5,581,266 | A * | 12/1996 | Peng et al. | 343/770 |
| 6,421,011 | B1 * | 7/2002 | Van Egmond et al. | 343/700 MS |
| 6,985,108 | B2 * | 1/2006 | Mikkola et al. | 343/700 MS |
| 2005/0176390 | A1 * | 8/2005 | Navsariwala et al. | 455/168.1 |

* cited by examiner

*Primary Examiner*—Tho Phan
(74) *Attorney, Agent, or Firm*—Ladas and Parry LLP

(57) ABSTRACT

An antenna assembly includes a base board having upper and lower surfaces, each of which defines a grounding domain and a dielectric domain, a first metal layer disposed on the grounding domain of the lower surface and a second metal layer disposed on the grounding domain of the upper surface, an antenna unit fabricated on the dielectric domain of the upper surface of the base board, and having an antenna body; and a plurality of conductive through holes formed through the base board for connecting electrically the first and second metal layers, thereby permitting coupled current flow generated in the second metal layer to flow into the first metal layer. A slot of predetermined length is formed through the first metal layer for enhancing effective coupled current flowing into the first metal layer.

17 Claims, 4 Drawing Sheets

ANTENNA ASSEMBLY AND METHOD FOR FABRICATING THE SAME

FIELD OF THE INVENTION

The present invention relates to an antenna assembly, more particularly to an antenna assembly including a ground plane formed with a slot and the method for fabricating the antenna assembly.

BACKGROUND OF THE INVENTION

Due to rapid innovation in the electronic communication technology, the welcome and preference of a cellular-phone handset depend on its outward appearance, size, and computing functions thereof. As for a wireless communication apparatus (such as a mobile phone), high reliability in the transmitting and receiving-signals, the quality and functionality of the antenna assembly play a major role in the mobile phone. The customer generally takes great consideration of the functionality and quality of the antenna assembly, when deciding in purchase of a mobile phone. It is therefore the prime object of the phone manufactures to improve the functionality and quality of the antenna assembly in the mobile phone.

Referring to FIG. 1, a conventional mobile phone, includes a base board 10 (a top planar view) and an antenna assembly mounted on the base board 10. The base board 10 includes multiple layers. The antenna assembly includes an antenna unit 12 and a plurality of conductive through holes 14. The antenna unit 12 includes an antenna body 120, a connector seat 122, and a feeding line 124. The antenna body 120, for example being helical-shaped, is seated on the connector seat 122. The feeding line 124 is coupled to a signal-processing module (not shown) of the conventional mobile phone. A ground layer (not visible) is disposed on a lower surface of the base board 10 while a radiating layer (not visible) is disposed on the upper surface of the base board 10. The conductive through holes 14 are used for guiding the coupled current generated in the ground layer to flow into the radiating layer so as to permit transmitting and receiving the radio signals.

FIG. 2 illustrates the flow direction of the coupled current in the base board 10, wherein the coupled current flows from the ground layer into the radiating layer via the conductive through holes 14. The ground layer is a full complete sheet (i.e. no opening or slot is formed therethrough), the coupled current flowing thereinto encounters no electrical impedance, thereby distributing the coupled current flow uniformly over the entire area of the ground layer. Under this condition, concentration of the coupled current flow into a specific portion of the ground layer cannot be achieved, which, in turn, shorten the effective current flow thereof, thereby restricting the transmission and receiving frequency bandwidth of the antenna assembly used in the conventional mobile phone.

SUMMARY OF THE INVENTION

The main object of the present invention is to provide an antenna assembly for use in a mobile phone. The antenna assembly includes a ground metal layer formed with an elongated slot.

Another object of the present invention is to provide a method for fabricating an antenna assembly.

Still another object of the present invention is to provide a mobile phone having an antenna assembly including a ground metal layer formed with an elongated slot.

In one aspect of the present invention, an antenna assembly is provided for use in a mobile phone. The antenna assembly accordingly includes: a base board made from a dielectric material, and having upper and lower surfaces, each of which defines a grounding domain and a dielectric domain, the base board further having a first metal layer disposed on the grounding domain of the lower surface and a second metal layer disposed on the grounding domain of the upper surface; an antenna unit fabricated on the dielectric domain of the upper surface of the base board, and including an antenna body and a feeding line; and a plurality of conductive through holes formed through the base board for connecting electrically the first and second metal layers, thereby permitting coupled current flow generated in the second metal layer to flow into the first metal layer; a first slot of predetermined length formed through the first metal layer for enhancing effective coupled current flowing into the first metal layer, thereby increasing transmitting and receiving ability of the antenna unit.

In a second aspect of the present invention, a method for fabricating an antenna assembly is provided and includes the steps of: (1) preparing a base board having upper and lower surfaces, each of which defines a grounding domain and a dielectric domain; (2) providing a first metal layer on the grounding domain of the lower surface of the base board; (3) providing a second metal layer on the grounding domain of the upper surface of the base board; (4) fabricating an antenna unit on the dielectric domain of the upper surface of the base board; (5) forming a plurality of conductive through holes through the base board for electrically connecting the first and second metal layers, thereby permitting coupled current flow generated in the second metal layer to flow into the first metal layer; and (6) forming a first slot of predetermined length in the first metal layer for enhancing effective coupled current flow flowing into the first metal layer, thereby increasing transmitting and receiving ability of the antenna unit.

In a third aspect of the present invention, a mobile phone is provided to include: a base board made of dielectric material, and having upper and lower surfaces, each of which defines a grounding domain and a dielectric domain, the base board further having a first metal layer disposed on the grounding domain of the lower surface and a second metal layer disposed on the grounding domain of the upper surface; and an antenna assembly mounted on the base board for transmitting and receiving radio signals. The antenna assembly includes: an antenna unit fabricated on the dielectric domain of the upper surface of the base board, and having an antenna body and a feeding line, a plurality of conductive through holes formed through the base board for electrically connecting the first and second metal layers, thereby permitting coupled current flow generated in the second metal layer to flow into the first metal layer, a first slot of predetermined length formed in the first metal layer for enhancing effective coupled current flow flowing into the first metal layer, thereby increasing transmitting and receiving ability of the antenna unit, and a RF module mounted on the base board and coupled electrically to the feeding line of the antenna unit for processing the radio signals.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTIONS OF THE PREFERRED EMBODIMENTS

Figure 1:
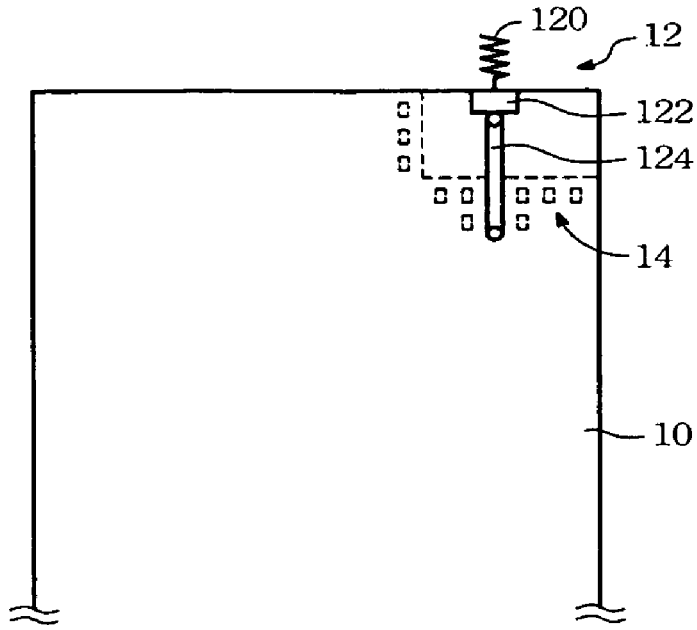
Fig. 1 (Prior Art)
FIG. 1 is a schematic view of an antenna assembly mounted in a conventional wireless telecommunication apparatus.
Figure 2:
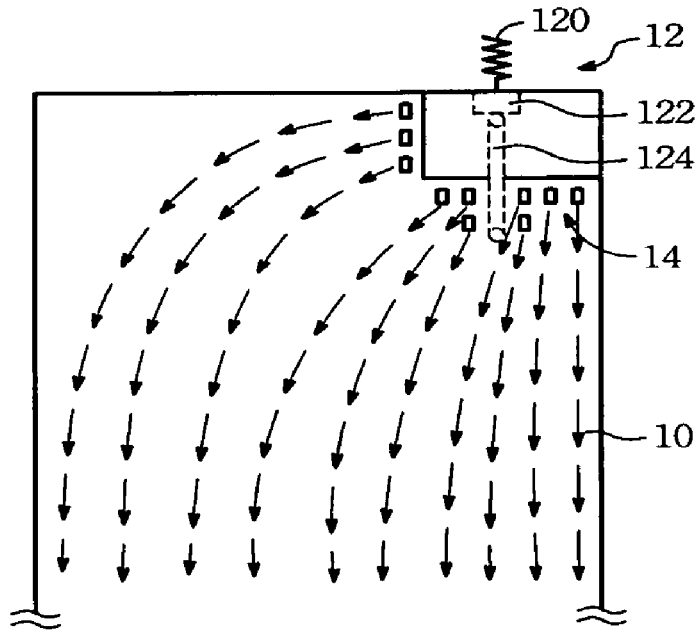
Fig. 2 (Prior Art)
FIG. 2 is a top planar view, illustrating the coupled current flow direction in the antenna assembly mounted within the conventional wireless telecommunication apparatus.
Figure 3:
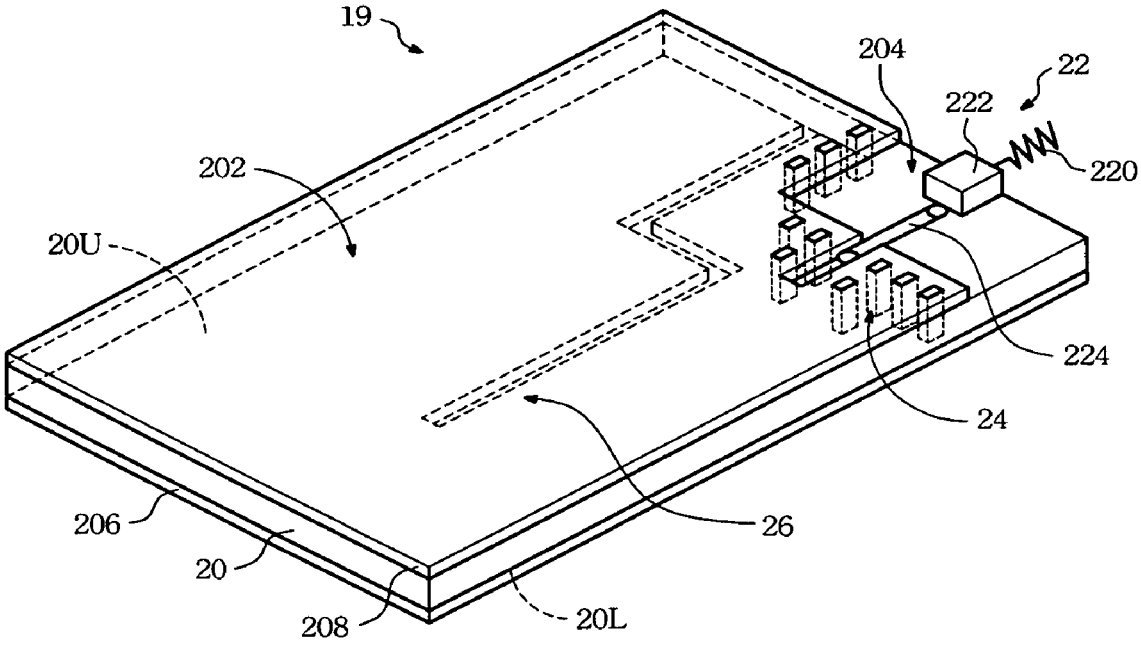
FIG. 3 is a perspective view of an antenna assembly according to the present invention.

Referring to FIG. 3, a perspective view of the preferred embodiment of an antenna assembly 19 according to the present invention is shown to include a base board 20, antenna unit 22, a plurality of conductive through holes 24, and first and second slots 26 (only one is shown in FIG. 3).

As illustrated, the base board 20 is made from a dielectric material (dielectric medium), and has opposite upper and lower surfaces 20U, 20L, each of which defines a grounding domain 202 and a dielectric domain 204 (the grounding and dielectric domains of the lower surface are not shown in FIG. 3). The dielectric material for forming the base board 20 is chosen from a group consisting of ceramic materials, FR-4 and FR-5 standard laminates and PTFE (polytetrafluoroethylene). The base board 20 further has a first metal layer 206 disposed on the grounding domain 202 of the lower surface 20L and a second metal layer 208 disposed on the grounding domain 202 of the upper surface 20U. The first and second metal layers 206, 208 cooperatively define a ground plane.

The antenna unit 22 is fabricated on the dielectric domain 204 of the upper surface 20U of the base board 20, and includes a coupling seat 222, an antenna body 220 fixed to the coupling seat 222 and projecting outwardly therefrom, and a feeding line 224. The feeding line 224 is used for coupling electrically the antenna body 220 to a signal processing module (not shown) so that the antenna body 220 can oscillate and convert the electrical signal into radio signal and vice versa. Note that a monopole antenna or a microstrip antenna (such as an inverted F-shaped antenna) is suitable for serving as the antenna body 220.

The conductive through holes 24 are formed through the grounding domain 202 in the base board 20 for coupling electrically the first and second metal layers 206, 208, thereby permitting coupled current flow generated in the second metal layer 208 to flow into the first metal layer 206. An important aspect to note is that the conductive through holes 24 are located adjacent to the dielectric domain 204 of the base board 20 (i.e. around the antenna unit 22). The first slot 26 of predetermined length is formed through the first metal layer 206. The second slot (not visible in FIG. 3) is formed through the second metal layer 208, and may be set a length the same as and in alignment with the first slot 26. By virtue of formation of the first and second slots through the first and second metal layers, the effective coupled current flow generated during use is enhanced, thereby increasing the transmitting and receiving ability of the antenna unit 22. Preferably, the antenna unit 22 is allotted with a predetermined transmission frequency. Each of the first and second slots has an effective length that is equivalent to or smaller than a quarter of the predetermined transmission frequency.

Figure 4:
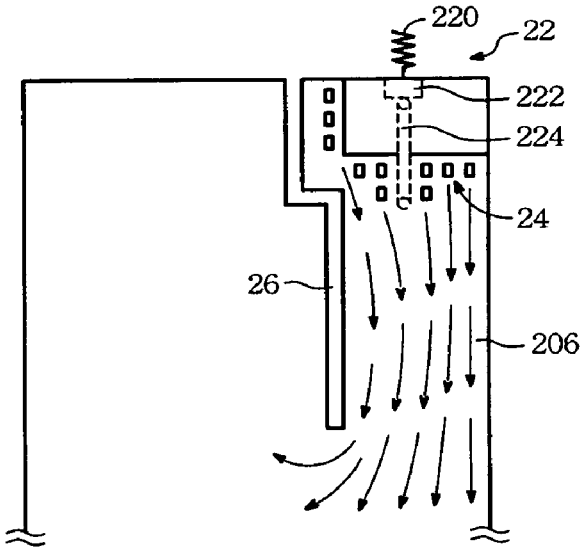
FIG. 4 is a top planar view, illustrating the coupled current flow direction in the antenna assembly according to the present invention.

Referring to FIG. 4, each of the slots 26 has an open end terminating at one end portion thereof and a closed end terminating within the respective metal layer, thereby effectively preventing distribution of the coupled current, which, in turn, enables the coupled current to concentrate into the right side portion of the slots 26. Under such arrangement, the coupled current flow uniformly in the respective metal layer via the conductive through holes 24 so as to enhance the effective length of the coupled current, thereby increasing the frequency bandwidth and quality of the antenna unit 22.

Figure 5:
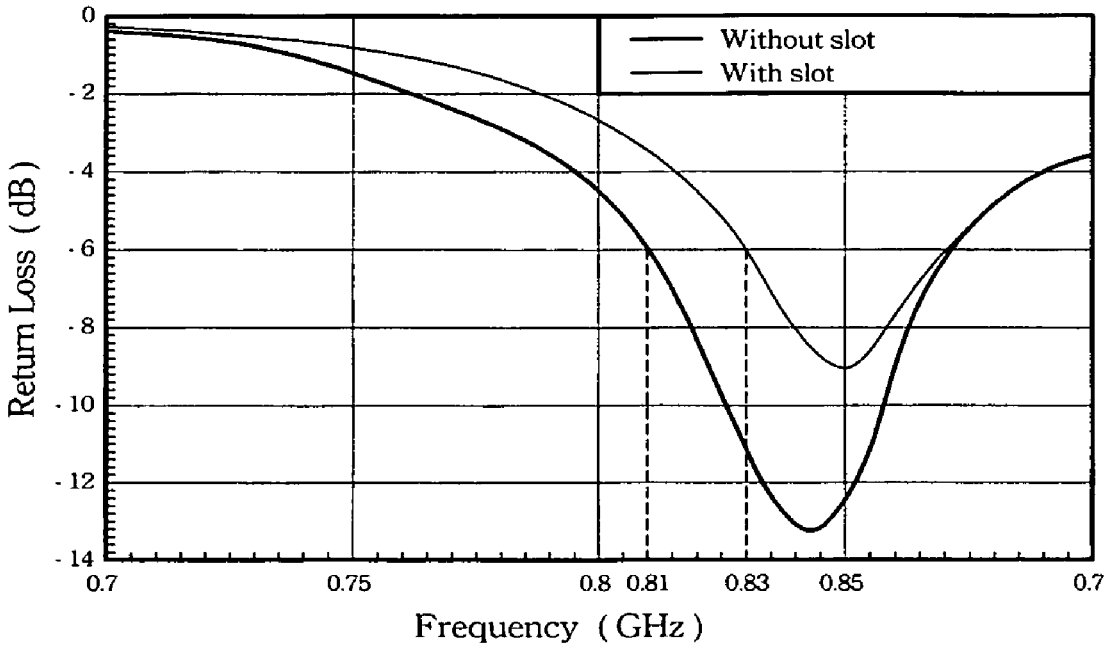
FIG. 5 illustrates a comparative graph obtained according to a computer stimulation of the antenna assembly of the present invention with respect to the conventional antenna assembly.

FIG. 5 is a comparative graph of the computer stimulation results (such as High Frequency Structure Simulator), illustrating the return loss verses frequency for the antenna assembly 19, wherein the graph line (represented by a thick black curve) of antenna assembly 19 possesses a substantial increase of 20 MHz bandwidth when compared to the conventional antenna assembly (represented by a thin black curve). In addition, the conventional antenna assembly (i.e. when the respective metal layer is not provided with a slot) has an antenna gain roughly 1.95 dBi. The antenna assembly (i.e. when the respective metal layer is provided with a slot) of the present invention has an antenna gain of roughly 2.78 dBi.

Figure 6:
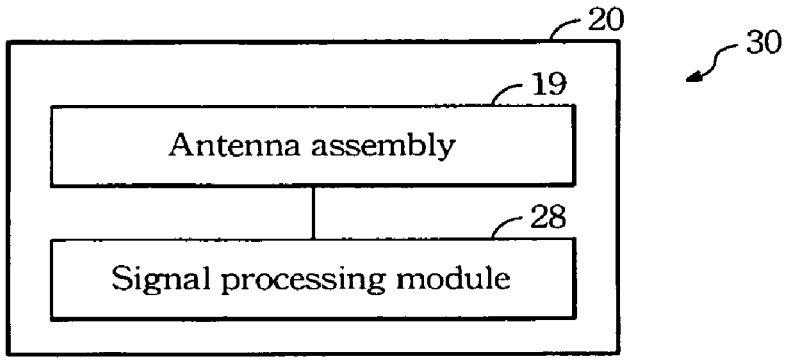
FIG. 6 is a block diagram, illustrating functional ability of a mobile phone equipped with the antenna assembly of the present invention.

FIG. 6 shows a block diagram, illustrating the functionality of a mobile phone 30 equipped with the antenna assembly 19 of the present invention. The mobile phone 30 includes a base board 20 and a signal processing module 28 (such as RF module) mounted on the base board 20. The base board 20 further has a plurality of electronic components that are required to perform the normal functions of the mobile phone 30. The antenna assembly 19 is mounted on the base board 20 for transmitting and receiving radio signals. Since antenna assembly has the same structure disclosed in the abovementioned paragraphs, a detailed disclosure thereof is omitted herein.

Figure 7:
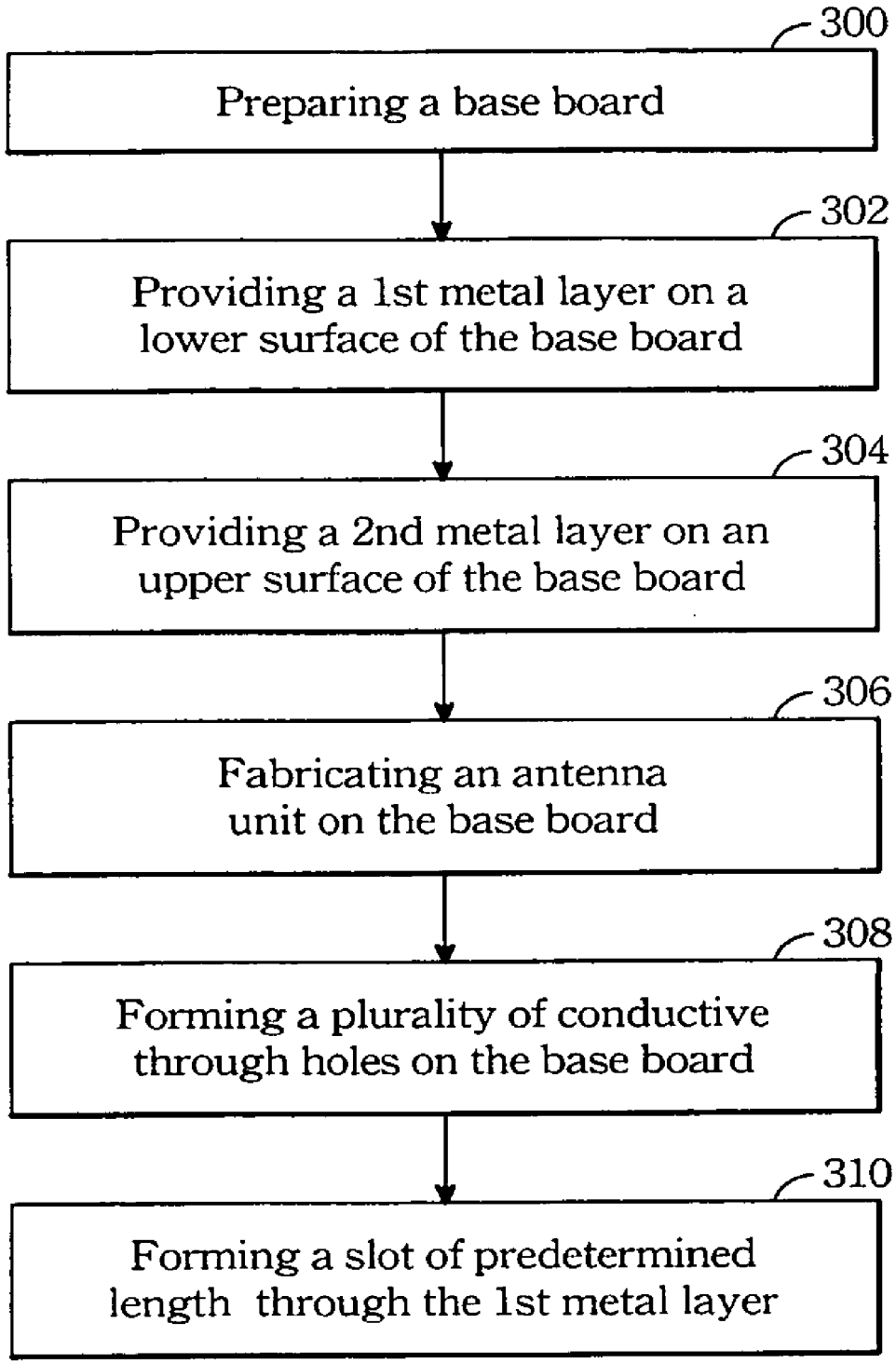
FIG. 7 shows a block diagram illustrating the steps for fabricating the antenna assembly of the present invention.

FIG. 7 shows a block diagram, illustrating the method for fabricating the antenna assembly of the present invention. According to the step (300), a base board 20 is prepared in such a manner to have upper and lower surfaces, each of which defines a grounding domain 202 and a dielectric domain 204. The step (302) includes the action of providing a first metal layer 206 on the grounding domain 202 of the lower surface of the base board 20. The step (304) includes the action of providing a second metal layer 208 on the grounding domain 202 of the upper surface of the base board 20, wherein the first and second metal layers 206, 208 cooperatively define a ground plane for the antenna assembly. According to the step (306), an antenna unit 22 is fabricated on the dielectric domain 204 of the upper surface of the base board 20. Afterward, in the step (308), a plurality of conductive through holes 24 are form through the base board 20 for electrically connecting the first and second metal layers 206, 208, thereby permitting coupled current flow generated in the second metal layer 208 to flow into the first metal layer 206. In the final step (310), a slot 26 of predetermined length is formed through the first metal layer 206 for enhancing effective coupled current flowing into the first metal layer 206, thereby increasing transmitting and receiving ability of the antenna unit 22. Note that the conductive through holes 24 are located adjacent to the dielectric domain 204 of the base board 20 (i.e. around the antenna unit 22). Preferably, another slot is formed through the second metal layer in alignment with the slot in the first metal layer 206. Each of the slots has an effective length that is equivalent to or smaller than a quarter of the predetermined transmitting frequency of the antenna assembly.

In summary, the antenna assembly of the present invention provides the following advantages over the conventional techniques:

(1) Since the first and second metal layers are provided with a slot respectively, the coupled current flow in the layers is enhanced, thereby increasing the transmitting frequency bandwidth, which, in turn, increase the impedance matching of the antenna assembly.

(2) By virtue of forming slots in the metal layers of the antenna assembly, the flow of coupled current in the metal layers can be concentrated into specific parts of the metal layers, the coupled current flowing via the conductive through holes 24 in the metal layers is uniform, thereby enhancing the effective length of the coupled current.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An antenna assembly comprising:

a base board made from a dielectric material, and having upper and lower surfaces, each of which defines a grounding domain and a dielectric domain, said base board further having a first metal layer disposed on said grounding domain of said lower surface and a second metal layer disposed on said grounding domain of said upper surface;

an antenna unit fabricated on said dielectric domain of said upper surface of said base board, and including an antenna body and a feeding line; and a plurality of conductive through holes formed through said base board for connecting electrically said first and second metal layers, thereby permitting coupled current flow generated in said second metal layer to flow into said first metal layer;

a first slot of predetermined length formed through said first metal layer for enhancing effective coupled current flowing into said first metal layer, thereby increasing transmitting and receiving ability of said antenna unit.

2. The antenna assembly according to claim 1, wherein said plurality of conductive through holes are formed through said grounding domain in said base board and are located adjacent to said dielectric domain thereof.

3. The antenna assembly according to claim 1, wherein said antenna unit is allotted to a predetermined transmitting frequency, said first slot having an effective length that is equivalent to or smaller than a quarter of said predetermined transmitting frequency.

4. The antenna assembly according to claim 1, wherein said antenna unit further has a second slot formed through said second metal layer in alignment with said first slot in said first metal layer.

5. The antenna assembly according to claim 1, wherein said first and second metal layers cooperatively define a ground plane.

6. The antenna assembly according to claim 1, wherein said antenna body is one of a monopole antenna body and a microstrip antenna body.

7. A mobile phone comprising:

a base board made of dielectric material, and having upper and lower surfaces, each of which defines a grounding domain and a dielectric domain, said base board further having a first metal layer disposed on said grounding domain of said lower surface and a second metal layer disposed on said grounding domain of said upper surface; and an antenna assembly mounted on said base board for transmitting and receiving radio signals, said antenna assembly including an antenna unit fabricated on said dielectric domain of said upper surface of said base board, and having an antenna body and a feeding line;

a plurality of conductive through holes formed through said base board for electrically connecting said first and second metal layers, thereby permitting coupled current flow generated in said second metal layer to flow into said first metal layer;

a first slot of predetermined length formed in said first metal layer for enhancing effective coupled current flowing into said first metal layer, thereby increasing transmitting and receiving ability of said antenna unit; and a RF module mounted on said base board and coupled electrically to said feeding line of said antenna unit for processing said radio signals.

8. The mobile phone according to claim 7, wherein said plurality of conductive through holes are formed through said grounding domain in said base board and are located adjacent to said dielectric domain thereof.

9. The mobile phone according to claim 7, wherein said antenna unit is allotted to a predetermined transmitting frequency, said first slot having an effective length that is equivalent to or smaller than a quarter of said predetermined transmitting frequency.

10. The mobile phone according to claim 7, wherein said antenna unit further has a second slot formed through said second metal layer in alignment with said first slot in said first metal layer.

11. The mobile phone according to claim 7, wherein said first and second metal layers cooperatively define a ground plane.

12. The mobile phone according to claim 7, wherein said antenna body is a monopole antenna body selected from a microstrip antenna group.

13. A method for fabricating an antenna assembly comprising the steps of:

(1) preparing a base board having upper and lower surfaces, each of which defines a grounding domain and a dielectric domain;

(2) providing a first metal layer on said grounding domain of said lower surface of said base board;

(3) providing a second metal layer on said grounding domain of said upper surface of said base board;

(4) fabricating an antenna unit on said dielectric domain of said upper surface of said base board;

(5) forming a plurality of conductive through holes through said base board for electrically connecting said first and second metal layers, thereby permitting coupled current flow generated in said second metal layer to flow into said first metal layer; and (6) forming a first slot of predetermined length in said first metal layer for enhancing effective coupled current flowing into said first metal layer, thereby increasing transmitting and receiving ability of said antenna unit.

14. The fabricating method according to claim 13, wherein said plurality of conductive through holes are formed through said grounding domain in said base board and are located adjacent to said dielectric domain thereof.

15. The fabricating method according to claim 13, wherein said antenna unit is allotted to a predetermined transmitting frequency, said first slot having an effective length that is equivalent to or smaller than a quarter of said predetermined transmitting frequency.

16. The fabricating method according to claim 13, wherein said antenna unit further has a second slot formed through said second metal layer in alignment with said first slot in said first metal layer.

17. The fabricating method according to claim 13, wherein said first and second metal layers cooperatively define a ground plane.

* * * * *

UNITED STATES PATENT AND TRADEMARK OFFICE

CERTIFICATE OF CORRECTION

PATENT NO. : 7,250,913 B1
APPLICATION NO. : 11/311676
DATED : July 31, 2007
INVENTOR(S) : Chih-Min Chang et al.

It is certified that error appears in the above-identified patent and that said Letters Patent is hereby corrected as shown below:

On title page, item 75, "Tzang" should read -- Tzeng --.

Signed and Sealed this

Twenty-third Day of October, 2007

JON W. DUDAS
*Director of the United States Patent and Trademark Office*